US005176113A

United States Patent [19]

Hama et al.

[11] Patent Number: 5,176,113

[45] Date of Patent: Jan. 5, 1993

[54] CYLINDER LINER

[75] Inventors: Fujio Hama; Kenichi Harashina, both of Okaya, Japan

[73] Assignee: Teikoku Piston Ring Co., Ltd., Tokyo, Japan

[21] Appl. No.: 850,309

[22] Filed: Mar. 12, 1992

[30] Foreign Application Priority Data

Mar. 14, 1991 [JP] Japan ..... 3-22555

[51] Int. Cl.[5] ..... F02F 1/14

[52] U.S. Cl. ..... 123/41.79; 123/41.84

[58] Field of Search ..... 123/41.83, 41.84, 41.79

[56] References Cited

U.S. PATENT DOCUMENTS

| | | | |
|---|---|---|---|
| 1,634,768 | 7/1927 | Bonner | 123/41.83 |
| 2,146,368 | 2/1939 | Dake | 123/41.8 |
| 2,464,462 | 3/1949 | Ricardo | 123/41.74 |

FOREIGN PATENT DOCUMENTS

| | | | |
|---|---|---|---|
| 451977 | 10/1948 | Canada | 123/41.84 |
| 0356227 | 2/1990 | European Pat. Off. . | |
| 1290700 | 5/1961 | France . | |

*Primary Examiner*—Noah P. Kamen

*Attorney, Agent, or Firm*—Armstrong & Kubovcik

[57] ABSTRACT

A cylinder liner having an outer circumferential surface having a plurality of groups of annular grooves, wherein each of the groups of annular grooves has two longitudinal grooves communicating the individual annular grooves with each other, forming an outlet and an inlet for the cooling oil and disposed at locations spaced apart by 180° in a circumferential direction, and the outlet communicates with the inlet in series in the adjoining groups of annular grooves. The outer circumferential surface has further a longitudinal groove connected to the lower end of the longitudinal groove forming the outlet of the lowermost group of annular grooves, a circumferential groove connected to the lower end of the longitudinal groove, and a longitudinal groove having the upper end connected to the circumferential groove and the lower end released, and the lowermost longitudinal groove is disposed at a circumferential position differing from the longitudinal grooves in the groups of annular grooves.

7 Claims, 2 Drawing Sheets

CYLINDER LINER

BACKGROUND OF THE INVENTION

1. Field of the Invention

This invention relates to a cylinder liner provided with cooling oil grooves at its outer circumferential surface.

2. Description of the Related Art

In prior art cooling systems for engines, cooling water is normally used for cooling operation. A cylinder block is typically provided with cooling water passages in case of a dry cylinder liner and, in case of a wet cylinder liner, a concave portion formed at an inner circumferential surface of a bore part of the cylinder block and an outer circumferential surface of a cylinder liner define the cooling water passage. The cooling water flows from a lower part of the cylinder liner to an upper part thereof and further flows to the cylinder head to cool the However, because improvement of engine performance in recent years has become an essential requirement, heat generated in a combustion chamber is also increased and a temperature at an upper part of the cylinder liner near the combustion chamber becomes excessively high. Accordingly, in view of designing engines having a compact size as well as a high speed and a high load capacity, the prior art cooling structure for the cylinder has a problem that the upper part of the cylinder liner near the combustion chamber cannot be sufficiently cooled.

In order to accommodate the foregoing, it has been proposed to provide a cylinder liner in which an outer circumferential surface of the cylinder liner is formed with a plurality of annular grooves, in which the plurality of annular grooves described above are divided into a plurality of groups of annular grooves, where each of the groups of annular grooves has two longitudinal grooves communicating the annular grooves with each other. The two longitudinal grooves forming an outlet and an inlet, respectively, for the cooling oil are disposed at locations spaced apart by 180° in a circumferential direction. The outlet communicates with the inlet in series with the adjoining groups of annular grooves. A total sectional area of the annular grooves in each of the groups of annular grooves is decreased from a lower part toward an upper part in an axial direction of the cylinder liner (referenced in Japanese Utility Model Application No. 62-60967).

With the foregoing, a flow of cooling oil directed from the upper part of the cylinder liner to the lower part thereof will be described, wherein the cooling oil flows around the outer circumference of the cylinder liner through groups of the annular grooves, and thereafter moves from the longitudinal groove forming the outlet of the group of annular grooves toward the longitudinal groove forming the inlet of the adjoining next stage group of annular grooves. The cooling oil then flows from the longitudinal groove into the annular grooves of the group of annular grooves, flows around the outer circumference of the cylinder liner, and then the cooling oil is moved to the lower adjoining group of annular grooves in the same manner.

The cooling oil is then discharged into the oil pan from a discharging longitudinal groove disposed on the extension line of the longitudinal groove forming the outlet of the lowermost group of annular grooves.

In this case, if the cooling oil drops onto the arm part of the crankshaft, the balance weight or the bearing of the connecting rod connected to the pin or the like when the cooling oil is discharged into the oil pan, a substantial flow rate of the cooling oil is flowed down, causing a load to be applied to the rotation of the crankshaft.

In addition, when the cooling oil strikes against the arm part of the rotating crankshaft, the cooling oil is dispersed to mix air during its dispersion and the cooling oil having air mixed therein is dropped into the oil pan. When air is mixed in the lubricant oil stored in the oil pan, the air flows into tee lubricant oil passages or the cooling oil passages together with the lubricant oil, so that the lubricating performance or the cooling performance is reduced.

Accordingly, the cooling oil to be discharged into the oil pan is preferably dropped onto the main shaft of the crankshaft.

However, if the circumferential positions of the longitudinal groove forming the outlet of the lowermost group of annular grooves are disposed above the main axis of the crankshaft, the longitudinal groove forming the inlet for the cooling oil in the group of annular grooves is disposed above the main axis of the crankshaft.

In the case of a multi-cylinder type engine, there is a problem that an arrangement of the inlets for the cooling oil above the main axis of the crankshaft causes the supplying passages formed in the cylinder block for supplying the cooling oil to the inlets for the cooling oil to be bypassed around bolt holes, and a formation of the supplying passages for the cooling oil extending from the side surface of the cylinder block to the inlets for the cooling oil in the cylinder liners is not facilitated due to the fact that the bolt holes used for fastening the cylinder liners to the cylinder block are disposed at the lateral positions between the bores of the cylinder block.

SUMMARY OF THE INVENTION

It is an object of the present invention to provide a cylinder liner in which a cooling oil supplying passage communicating with an inlet for the cooling oil in the cylinder liner may be easily formed in a cylinder block.

The cylinder liner of the present invention contains an outer circumferential surface having a plurality of groups of annular grooves, wherein each of the groups of annular grooves has two longitudinal grooves allowing communication between the annular grooves. The two longitudinal grooves forming an outlet and an inlet, respectively, for the cooling oil are disposed at locations spaced apart by 180° in a circumferential direction. The outlet communicates with the inlet in series with the adjoining groups of annular grooves. A total sectional area of the annular grooves in each of the groups of annular grooves is decreased from a lower part toward an upper part thereof. The outer circumferential surface has further a longitudinal groove connected to the lower end of the longitudinal groove forming the outlet of the lowermost group of annular grooves, and a circumferential groove connected to the lower end of the longitudinal groove and a longitudinal groove having an upper end connected to the circumferential groove and a lower end released, wherein the longitudinal groove having the upper end connected to the circumferential groove and the lower end released is disposed at a different circumferential position than the longitudinal grooves in the groups of annular grooves.

An outer circumferential surface at a higher position than the uppermost group of annular grooves may be provided with one annular groove communicating with the longitudinal groove forming the inlet of the uppermost group of annular grooves.

According to the cylinder liner of the present invention, in the case where the cylinder liner is installed in the cylinder block in such a way so that the position of the cooling oil discharging groove in the cylinder liner is disposed above the main axis of the crankshaft, the cooling oil inlet of the cylinder liner is disposed at the circumferential position apart from above the main axis of the crankshaft, so that the cooling oil supplying passage extended from the side surface of the cylinder block to the cooling oil inlet in the cylinder liner can be arranged at a position far apart from the bolt holes used in fastening the cylinder liner, wherein the bolt holes are disposed at the lateral positions between the bores of the cylinder block. The cooling oil supplying passage can then be easily formed.

BRIEF DESCRIPTION OF THE DRAWINGS

The aforesaid and other objects and features of the present invention will become more apparent from the following detailed description and the accompanying drawings.

DESCRIPTION OF THE PREFERRED EMBODIMENT

Cooling oil grooves are formed at an outer circumferential surface of a cylinder liner of a 96 HP in-line four cylinder diesel engine, with, for example, an inner diameter of 84 mm, and a stroke of 89 mm.

Figure 1:
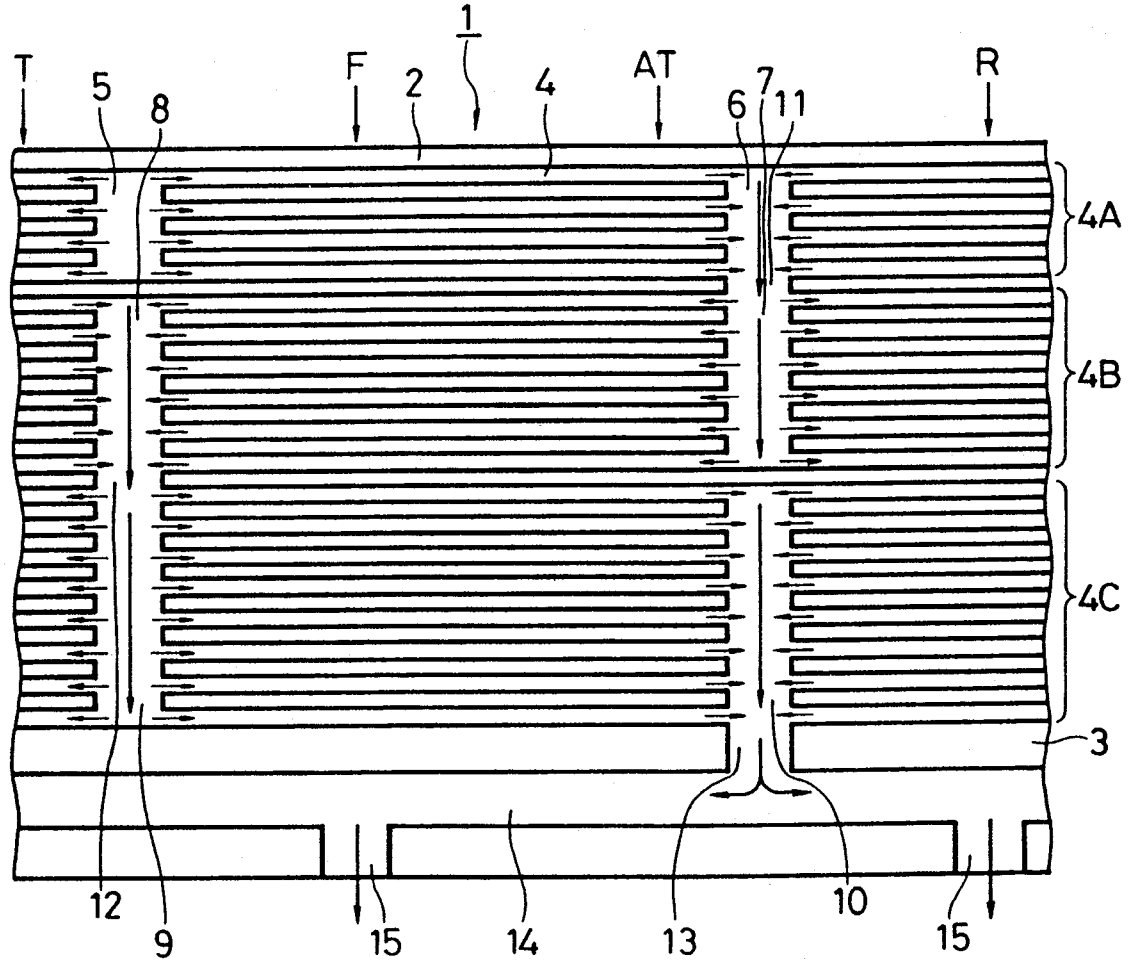
FIG. 1 shows part of the outer circumferential surface of the cylinder liner of the present invention.
Figure 2:
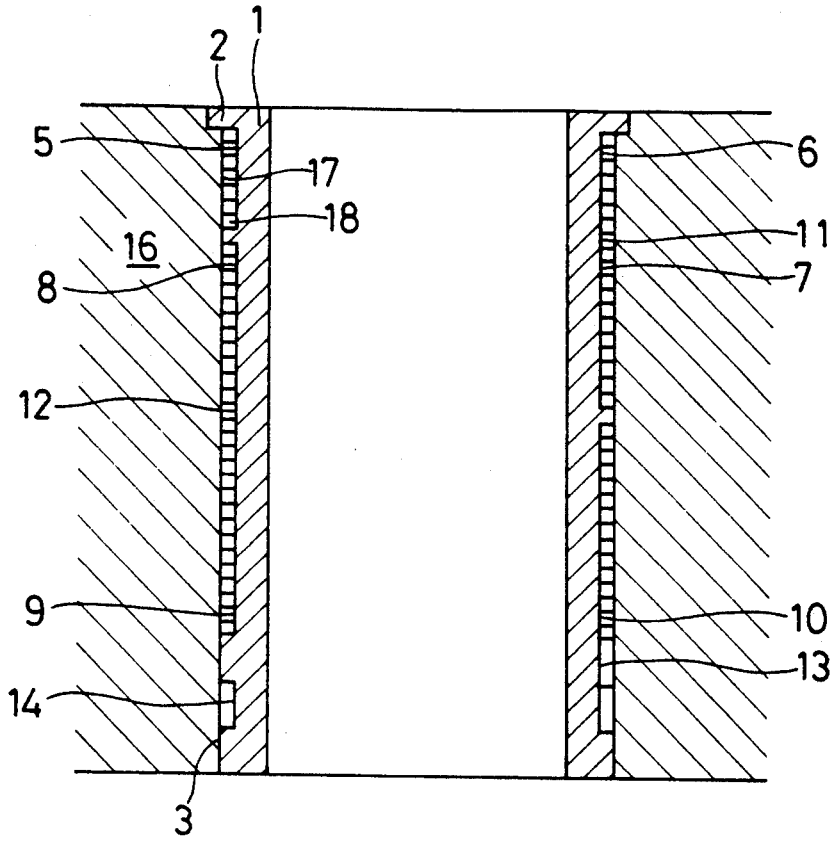
FIG. 2 is a longitudinal sectional view taken at the longitudinal grooves of the cylinder liner to show a bore part of a cylinder block into which the cylinder liner of the present invention is fitted.

That is, as shown in FIGS. 1 and 2, the cylinder liner 1 has a flange 2 at its upper end, and an outer circumferential surface 3 of the cylinder liner below the flange 2 is formed with eighteen annular grooves 4 in an axially spaced-part relationship. These annular grooves 4 are divided into three groups of annular grooves.

The three groups of annular grooves are the first group 4A of annular grooves ranging from the first annular groove 4 at the upper end of the cylinder liner to the fourth annular groove 4, the second group 4B of annular grooves ranging from the fifth annular groove 4 to the tenth annular groove 4 and the third group 4C of annular grooves ranging from the eleventh annular groove 4 to the last eighteenth annular groove 4.

In the first group 4A of annular grooves, two longitudinal grooves 5 and 6 communicating the annular grooves 4 with each other are provided at two positions spaced apart by 180° in a circumferential direction of the cylinder liner 1, in which one longitudinal groove 5 forms a cooling oil inlet and the other longitudinal groove 6 forms a cooling oil outlet. Similarly, in the second group 4B of annular grooves, two longitudinal grooves 7 and 8 communicating the annular grooves 4 with each other are provided at the same two positions in the circumferential direction as the longitudinal grooves 5 and 6 of the first group 4A of annular grooves, in which the longitudinal groove 7 located at the cooling oil outlet side of the first group 4A of annular grooves forms a cooling oil inlet and the other longitudinal groove 8 forms a cooling oil outlet. Also in the third group 4C of annular grooves, two longitudinal grooves 9 and 10 communicating the annular grooves 4 with each other are provided at the same two positions in the circumferential direction as the longitudinal grooves 7 and 8 of the second group 4B of annular grooves in their circumferential directions, in which the longitudinal groove 9 located at the cooling oil outlet side of the second group 4B of annular grooves forms a cooling oil inlet and the other longitudinal groove 10 forms a cooling oil outlet.

The longitudinal groove 6 forming the cooling oil outlet of the first group 4A of annular grooves and the longitudinal groove 7 forming the cooling oil inlet of the second group 4B of annular grooves are communicated in series by a longitudinal groove 1 which is located at the same circumferential location as those of said longitudinal grooves 6 and 7 and is formed at the outer circumferential surface of the cylinder liner between the fourth annular groove 4 and the fifth annular groove 4. In addition, similarly, the longitudinal groove 8 forming the cooling oil outlet of the second group 4B of annular grooves and the longitudinal groove 9 forming the cooling oil inlet of the third group 4C of annular grooves are communicated in series by a longitudinal groove 12 which is located at the same circumferential location as those of said longitudinal grooves 8 and 9 and is formed at the outer circumferential surface of the cylinder liner 1 between the tenth annular groove 4 and the eleventh annular groove 4.

The annular grooves 4 are formed in a plane perpendicular to an axis of the cylinder liner 1 and have rectangular sectional shapes. Their widths and depths are all the same. Longitudinal grooves 5, 6, 7, 8, 9, 10, and 12 have also rectangular sectional shapes, are disposed in parallel with an axis of the cylinder liner 1 and their widths and depths are all the same.

A lower part of the outer circumferential surface 3 of the cylinder liner is formed with discharging grooves. That is, the discharging grooves are comprised of a longitudinal groove 13 connected to the lower end of the longitudinal groove 10 forming an outlet of the third group 4C of annular grooves and disposed on an extension line of the longitudinal groove 10; an annular groove 14 connected to the lower end of the longitudinal groove 13 and formed in a plane perpendicular to an axis of the cylinder liner 1; and two longitudinal grooves 15 having their upper ends connected to the annular groove 14, extended down to the lower end of the cylinder liner 1 and disposed in parallel with an axis of the cylinder liner The longitudinal grooves 15 are disposed at locations spaced apart by 180° in their circumferential direction. Their circumferential positions are disposed at locations apart by about 60° in the same direction from the longitudinal grooves 5, 7 and 9 forming inlets, and the longitudinal grooves 6, 8 and 10 forming outlets which are made at each of the groups of annular grooves 4A, 4B and 4C. When the cylinder liner is to be installed in a cylinder block 16 to be described later, the discharging longitudinal grooves 15 are placed above the main axis of the crankshaft.

Although the aforementioned discharging annular groove 14 is formed around an entire circumference in the outer circumferential surface 3 of the cylinder liner, it may not be formed around the entire circumference, but may be formed at a part of the entire circumference. Although the longitudinal grooves 15 below the groove 14 preferably extend down to the lower end of the cylinder liner, it is sufficient that in case the cylinder liner has the lower end smaller in diameter than the upper part thereof, the grooves extend down to the upper end position of the small diameter part thereof.

The discharging longitudinal grooves 13 and 15 have rectangular cross sections, their widths and depths are the same as those of the longitudinal grooves 5, 6, 7, 8, 9 and 10 of the groups of annular grooves. The discharging annular groove 14 has a rectangular cross section and its depth is the same as that of the annular groove 4 in the groups of annular grooves. However, it is preferable that the width of the discharging annular groove 14 is relatively large. In the preferred embodiment of the present invention, the groove width of the discharging annular groove 14 is three to five times of that of the annular groove 4 in the groups of annular grooves.

Figure 3:
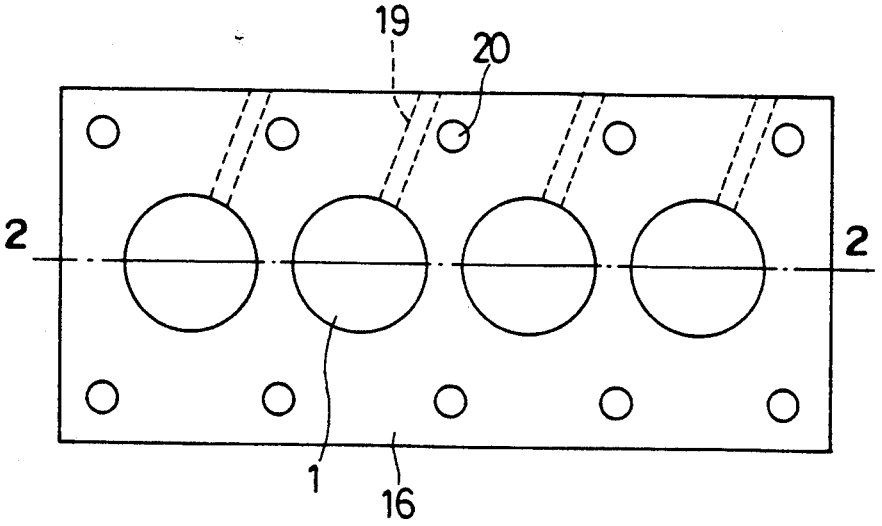
FIG. 3 is a top plan view showing the cylinder block into which the cylinder liner of the present invention is fitted.

The cylinder liners 1 are respectively fitted into the bore parts of the cylinder block 16 (as shown in FIG. 2), and a spacing defined by the inner circumferential surface 17 of the bore part and the grooves 4 to 15 of the cylinder liner 1 forms the cooling oil passage 18. In this case, the cylinder liner 1 is installed in such a way that the discharging longitudinal grooves 15 extending down to the lower end of the cylinder liner are disposed above the main axis line X of the crankshaft (as shown in FIG. 3). Accordingly, the longitudinal groove 5 forming the inlet for the cooling oil in the cylinder liner 1 is disposed at a circumferential position apart by about 60° from above the main axis line X of the crankshaft. Cooling oil supplying passages 19 (refer to FIG. 3) connected to the longitudinal grooves 5 are extended linearly in a lateral direction from the side surface of the cylinder block 16 to the longitudinal grooves 5. In this way, the cooling oil supplying passages 19 can be disposed linearly at the positions avoiding the bolt holes 20 for use in fastening the cylinder liner (as shown in FIG. 3) arranged at lateral positions between the bores of the cylinder block 16, so that the cooling oil supplying passages 19 to be disposed in the cylinder block 16 may be easily formed.

Accordingly, as shown in FIG. 1, the cooling oil passing through the cooling oil supplying passage 19 in the cylinder block 16 and flowing into the longitudinal groove 5 forming the inlet of the first group 4A of annular grooves in the cylinder liner flows in the annular grooves 4 in the first group 4A of annular grooves toward an opposite side of 180° and flows from the longitudinal groove 6 forming the outlet of the first group 4A of the annular grooves into the longitudinal groove 7 forming the inlet of the second group 4B of annular grooves.

The cooling oil flows in the annular grooves 4 in the second group 4B of annular grooves toward the opposite side of 180°, and flows from the longitudinal groove 8 forming the outlet of the second group 4B of annular grooves into the longitudinal groove 9 forming the inlet of the third group 4C of annular grooves.

The cooling oil flows in the annular grooves 4 in the third group 4C of annular grooves toward the opposite side of 180°, then flows from the longitudinal groove 10 forming the outlet of the third group 4C of annular grooves into the longitudinal groove 13 containing to the longitudinal groove 10, then flows into the annular groove 14, flows around the annular groove 14, drops from the two longitudinal grooves 15 at the lowest end onto the main axis of the crankshaft (not shown), and thereafter flows down into the oil pan (not shown).

In this case, the total sectional areas of the annular grooves for the cooling oil in the three groups 4A, 4B, and 4C of annular grooves have a ratio of 2:3:4. A flow speed of the cooling oil flowing in each of the groups 4A, 4B and 4C of annular grooves is as follows. A flow speed of the cooling oil in the second group 4B of annular grooves is faster than that of the cooling oil in the third group 4C of the annular grooves, and a flow speed of the cooling oil in the first group 4A of annular grooves is faster than that of the cooling oil in the second group 4B of annular grooves.

Accordingly, the coefficient of heat-transfer of the cooling oil is increased as it goes up to the upper part of the cylinder liner 1, and as a result the cooling capability is increased from a lower part toward an upper part and an appropriate cooling corresponding to the temperature gradient in an axial direction of the cylinder liner is carried out.

Although in the aforementioned preferred embodiment, the sectional shape of the annular groove is a rectangular one, this is not limited to a rectangular one but it may be a V-shape, a semi-circular one and there is no specific limitation. However, in order to increase a thermal transfer area, a rectangular shape as in the present preferred embodiment, or a square shape is preferable.

In the aforementioned preferred embodiment, a plurality of annular grooves spaced-apart in an axial direction of the cylinder liner are divided into the three groups of annular grooves, and a total sectional area of the annular grooves for the cooling oil in each of the groups of annular grooves is decreased from a lower part toward an upper part. However, it is also preferable that the annular grooves may be divided into two groups of annular grooves or more than three groups of annular grooves and then a total sectional area of the annular grooves for the cooling oil in each of the groups of annular grooves may be decreased from a lower part toward and upper part.

In the cylinder liner of the present invention, an outer circumferential surface at an upper position than the uppermost group of annular grooves may be provided with one annular groove communicating with the longitudinal groove forming the inlet of the uppermost group of annular grooves.

The aforementioned cooling structure may be used in both gasoline and diesel engines. In addition, in the aforementioned cooling structure, a cylinder block consisting of an aluminum die casting or a sectional cylinder block may be used.

Although the present invention has been described with reference to the preferred embodiment, it is apparent that the invention is not limited to the aforementioned preferred embodiment, but various modifications can be attained without departing from its scope.

What is claimed is:

1. A cylinder liner comprising:

an outer circumferential surface provided with a plurality of groups of annular grooves, wherein each of said groups of annular grooves has first and second longitudinal grooves communicating said annular grooves with each other, forming an outlet and an inlet, respectively, for cooling oil and disposed at locations spaced apart by 180° in a circumferential direction, wherein said outlet communicates with said inlet in series in said adjoining groups of annular grooves, wherein a total sectional area of said annular grooves in each of said groups of annular grooves is decreased from a lower part toward an upper part in an axial direction of said cylinder liner, and wherein said outer circumferential surface has further a third longitudinal groove connected to a lower end of said first longitudinal groove forming the outlet of said lowermost group of annular grooves, a circumferential groove connected to a lower end of said third longitudinal groove, and a fourth longitudinal groove having an upper end connected to said circumferential groove and a lower end open, and said fourth longitudinal groove having the upper end connected to said circumferential groove and the lower end open, is disposed at a different circumferential position from said first and second longitudinal grooves in each of said groups of annular grooves.

2. A cylinder liner according to claim 1, in which an outer circumferential surface at a position higher than said uppermost group of annular grooves is provided with one annular groove communicating with said second longitudinal groove forming said inlet of said uppermost group of annular grooves.

3. A cylinder liner according to claim 1 or 2, in which a groove width of said circumferential groove is greater than that of said annular groove in said groups of annular grooves.

4. A cylinder liner according to claim 1 or 2, in which said circumferential groove is formed around an entire circumference.

5. A cylinder liner according to claim 1 or 2, in which said circumferential groove is formed around a part of an entire circumference.

6. A cylinder liner according to claim 1 or 2, in which the number of said groups of annular grooves is two or more.

7. A cylinder liner according to claim 1 or 2, wherein said liner is inserted into a cylinder block in such a way that said lowermost longitudinal groove is disposed above a main axis of a crankshaft.

* * * * *